United States Patent [19]

Henrich

[11] 4,050,640

[45] Sept. 27, 1977

[54] APPARATUS FOR WINDING WIRE AND THE LIKE

[75] Inventor: Werner Henrich, Horbach, Germany

[73] Assignee: Firma Henrich KG, Horbach, Germany

[21] Appl. No.: 608,001

[22] Filed: Aug. 26, 1975

Related U.S. Application Data

[63] Continuation-in-part of Ser. No. 432,360, Jan. 10, 1974, abandoned.

[30] Foreign Application Priority Data

Jan. 13, 1973 Germany ..... 2301594

[51] Int. Cl.[2] ..... B65H 54/02

[52] U.S. Cl. ..... 242/25 R; 242/47

[58] Field of Search ..... 242/47, 25 R, 25 A, 242/18 R, 54 R, 82, 83; 57/68–71

[56] References Cited

U.S. PATENT DOCUMENTS

| | | | |
|---|---|---|---|
| 948 | 9/1838 | Evans et al. | 57/68 |
| 633,957 | 9/1899 | Graf | 57/68 X |
| 1,191,960 | 7/1916 | Good | 57/68 |
| 1,194,834 | 8/1916 | Good | 57/68 |
| 2,015,128 | 9/1935 | Ruf | 57/68 |
| 2,475,427 | 7/1949 | Henning | 57/68 |
| 3,038,674 | 6/1962 | Wahl | 242/25 R |
| 3,345,810 | 10/1967 | Wiesnagrotzki et al. | 57/68 |
| 3,677,483 | 7/1972 | Henrich | 242/25 R |
| 3,762,150 | 10/1973 | Akachi | 57/71 X |

*Primary Examiner*—Stanley N. Gilreath
*Attorney, Agent, or Firm*—Edmund M. Jaskiewicz

[57] ABSTRACT

The spool upon which the wire is to be wound is mounted upon a carriage which is movable into and out of the apparatus. A flyer having guide rollers threon to guide the wire upon the spool is mounted for rotary movement around the spool and for reciprocating movement in a direction parallel to the axis of the spool. The spool is rotated in a direction opposite to the direction of rotation of the flyer during winding. At least one guide roll is provided with adjustable pitch fan blades to provide additional rotary drive of the roller.

3 Claims, 8 Drawing Figures

APPARATUS FOR WINDING WIRE AND THE LIKE

RELATED APPLICATION

This application is a continuation-in-part of the copending application Ser. No. 432 360 filed Jan. 10, 1974 by the same-named applicant, now abandoned.

The present invention relates to an apparatus for winding wire, strands, cables, ropes and the like as delivered from manufacturing or processing machinery to be wound upon a spool, more particularly, to such an apparatus wherein the spool is rotated and the flyer is rotated around the spool in the opposite direction thereof during winding.

In one form of a wire winding apparatus the spool upon which the wire is wound is rotatably mounted and a flyer or level winding device reciprocates along the axis of the spool to wind the wire in uniform layers on the spool between its flanges. A suitable structure, such as a compensating roller, may be employed to sense a tension of the wire during winding to control the angular velocity of the spool to prevent the formation of irregularities in the surface of the wound wire on the spool. The angular velocity of the spool is also controlled to control the speed of the wire as the spool becomes full which could lead to an undesired increase in the tension of the wire and to a subsequent breaking thereof. Such a control of the spool angular velocity is difficult when the wire is being wound at a very high speed. Such control is virtually impossible to achieve when the capacity of the spool is substantially larger than that of presently employed spools since under these circumstances the mass of the spool and the wound wire thereon become too large for the control system to handle properly. Because of the great weight of the spool and wire the bearings supporting the spool are subjected to an excessive load which thus severely limits the winding speed of the wire and high winding speeds cannot be obtained.

It is desirable to employ spools which have a relatively high capacity upon which a very large quantity of wire can be wound. This is advantageous during further processing of the wire in a continuing operating since considerably longer lengths of wire can be processed and accordingly the process of connecting the ends of wire upon changing from one spool to another is less frequent. Such a joining of the wire ends is most undesirable during further processing of the wire since it produces a significant reduction in quality of the wire and frequently the intermediate or final product must be rejected.

Such high capacity spools are also advantageous for the wire drawing machine since it is now possible to run the drawing machine for a longer period of time and a full spool need be replaced by an empty spool less frequently. Even when double spools are used in a continuous operation the changing from one spool to another still produces an undesirable disturbance and undue wear during the wire processing operation.

Another form of a wire winding apparatus employs a stationary spool and a flyer rotates around the spool. The flyer essentially comprises a frame upon which a plurality of guide rollers are mounted to guide the wire upon the spool. The flyer moves about the spool in such a manner that the wire is wound in uniform layers upon the spool. Such a flyer has a mass which is relatively small with respect to the spool and this mass remains constant during the winding of the wire on the spool. Consequently, the winding speed can be precisely controlled since the flyer is more sensitive and responsive to such controls. However, at extremely high speeds certain centrifugal forces are produced which become too great for operation of the flyer and permissible stress of the flyer components may be exceeded. Also, the bearing friction in the wire guiding rollers may become so great that the rollers are no longer driven by the wire passing over the rollers and the wire is susceptible of breaking.

It is therefore the principal object of the present invention to provide a novel and improved wire winding apparatus.

It is another object of the present invention to provide a wire winding apparatus which will wind wire at high speeds on spools of practically any size and capacity.

According to one aspect of the present invention an apparatus for winding wire and the like may comprise means for supporting the spool upon which wire is to be wound and a flyer movable with respect to the spool for winding the wire thereon. The flyer is rotated around the spool in one direction and the spool is rotated in a direction opposite to the direction of rotation of the flyer. The flyer is provided with at least one guide roller to guide the wire during the winding operation and the guide roller is driven by a motor connected thereto or by fan blades mounted upon the roller. The spool and flyer may be driven from separate power sources or through individual transmissions from a single power source with provision being made for precisely controlling the angular velocities of the spool and flyer.

By rotating the spool and flyer opposite to each other the speed at which the wire is being wound is in effect sub-divided between the flyer and the spool. Thus, each angular velocity of the flyer and spool may be individually selected within the permissible limits therefor and, if desired, the two angular velocities may be identical.

Other objects and advantages of the present invention will be apparent upon reference to the accompanying description when taken in conjunction with the following drawings, which are exemplary, wherein;

FIG. 1. is a longitudinal sectional view through the winding apparatus of the present invention;

FIG. 2. is an end elevational view of the apparatus of FIG. 1 looking in the direction of the arrow II;

Figure 1:
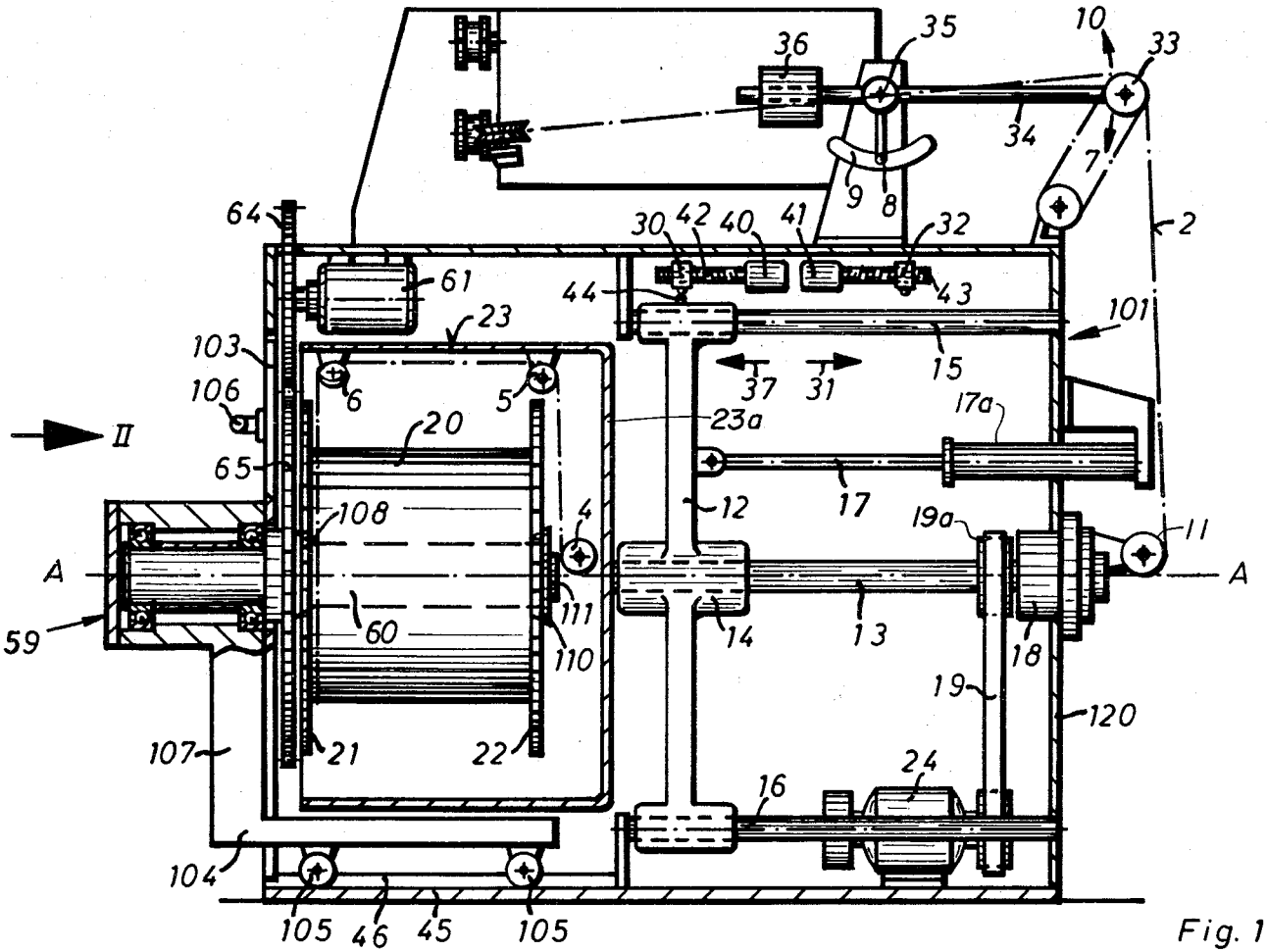
Figure 4:
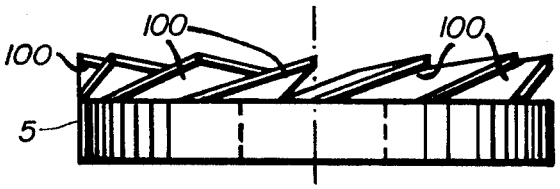
FIG. 4 is a side elevational view of the roller of FIG. 3.
Figure 3:
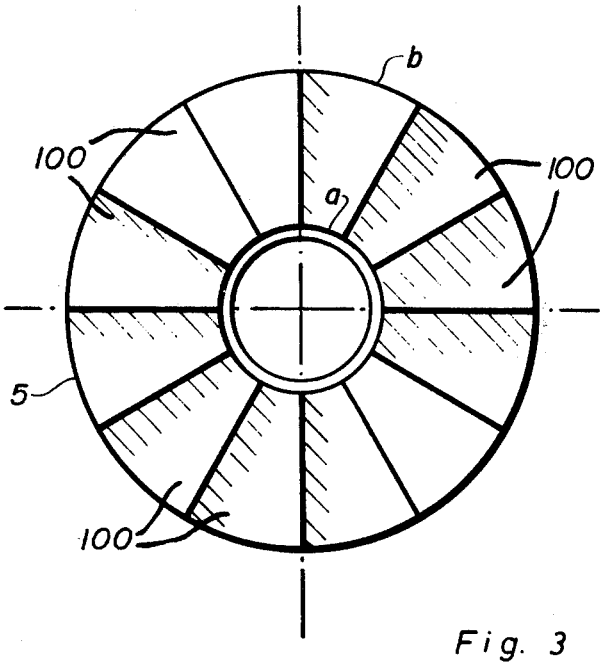
FIG. 3 is a plan view of a guide roller for the flyer and having blades thereon.
Figure 5:
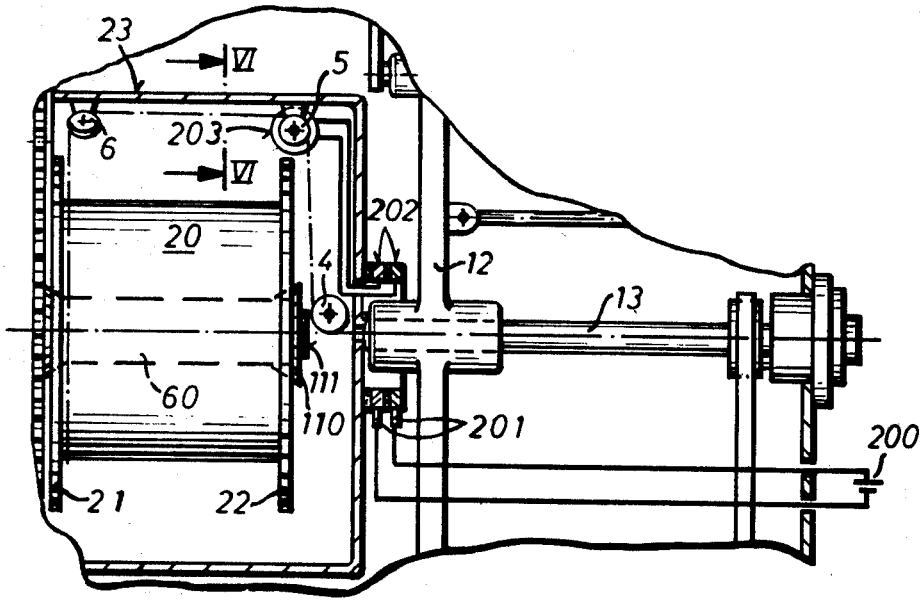
Figure 6:
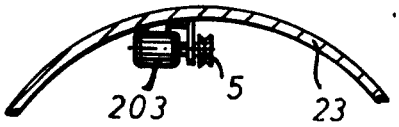
Figure 7:
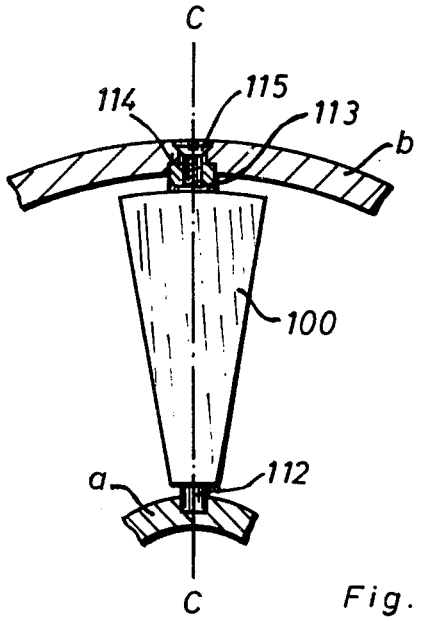
Figure 8:
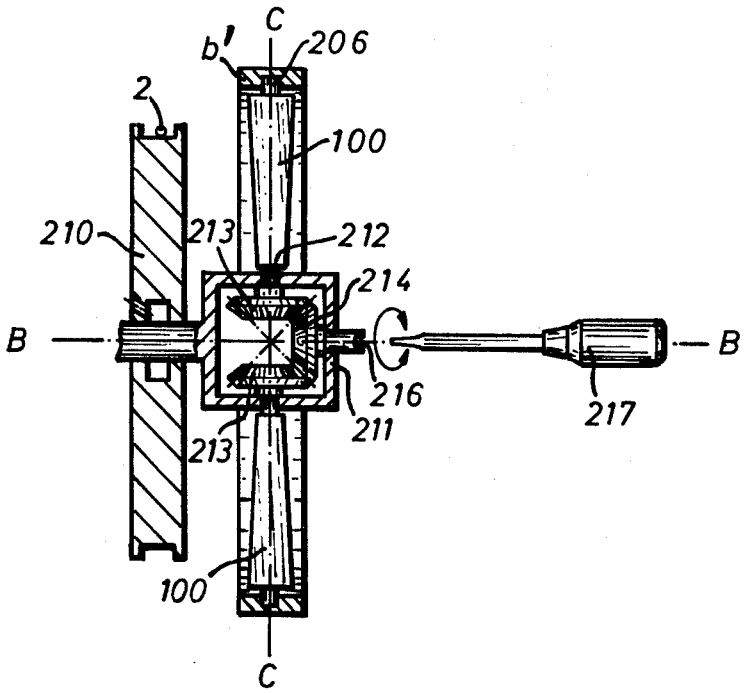

FIG. 5. is a portion of the view of FIG. 1 and showing a modification thereof wherein the guide roller is driven by an electric motor;

FIG. 6 is a sectional view taken along the line VI-VI of FIG. 5;

FIG. 7 is a plan view of a blade of the roller of FIGS. 3 and 4 with portions of the roller being shown in section; and FIG. 8 is a view similar to that of FIG. 7 but of a modification for adjusting the blades of the roller.

Proceeding next to the drawings wherein like reference symbols indicate the same parts throughout the various views, a specific embodiment and modification of the present invention will be described in detail.

Figure 2:
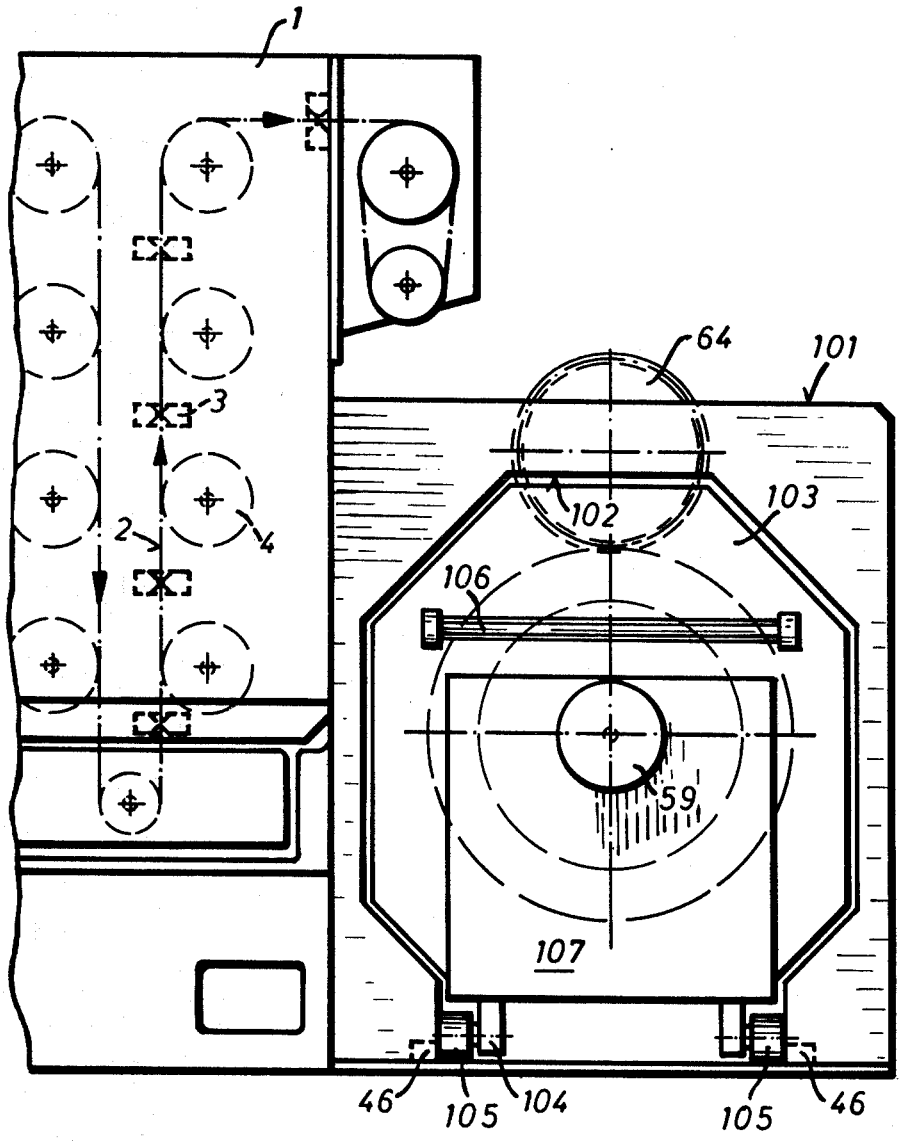

In FIG. 1 and 2 there is shown a wire drawing machine 1, through which a wire 2 is drawn through drawing dies 3 by means of driven rollers 4 and then supplied to a winding apparatus 101 either directly or after subsequent treatment, such an annealing or the like. The wire 2 enters the winding apparatus over a roller 11 mounted on the exterior of a housing 120 which encloses the apparatus. The pulley 11 which is fixed to the housing 120 is in practice structurally positioned further to the right so that when the shaft 13 is moved to the right the guide roller 11 will still be positioned to the right of the end of the shaft 13. As illustrated, the dimensions of the brackets supporting the guide roller 11 are not to scale but are for the purposes of illustrating the structure aspects of the invention. The wire passes from the roller 11 through a hollow tubular support 13 and along its axis which constitutes the axis of rotation A—A of a flyer comprising a cylindrical frame 23 having a closed end 23a and a plurality of guide rollers 4, 5 and 6 rotatably mounted on the frame. The length of frame 23 is greater than the axial length of the spool 20 so that the spool is completely enclosed by the frame in its extreme left portion as shown in FIG. 1. The inner surface of such a closed cylindrical frame would permit the wire being wound to be limited by the surface when the wire is subjected to high centrifugal force during winding. The closed frame would thus prevent buckling and breaking of the wire.

In this embodiment the axis of rotation of the flyer is horizontal but the axis can also be positioned vertically to achieve the same results and advantages of the present invention.

The wire passes around the guide rollers 4, 5 and 6 and is positioned by the roller 6 upon spool 20 around the rotary axis of the spool and between the flanges 21 and 22 when the flyer rotates around the spool. The flyer is rotated by a variable speed transmission 24 which is coupled to the wire drawing machine 1 and which drives a shaft 13 having a non-circular cross-section by means of a driving belt 19. As an alternative, a separate drive, independent of the drawing machine, may be provided for the flyer.

The shaft 13 has one end thereof journaled at 18 and the other end journaled at 14 on the movable frame 12.

The flyer is supported upon a frame 12 which is displaceable along guide rods 15 and 16. The flyer frame or supporting structure 12 is connected to a piston rod 17 extending from a cylinder 17a which is actuated mechanically, hydraulically or pneumatically in a known manner and is reciprocated over a range predetermined to position the wire from the guide roller 6 in uniform layers between the flanges of the spool 20.

The shaft 13 has a polygonal or non-circular cross-section and is slidable through the pulley 19a and bearing 18 which are retained in their respective positions as shown in FIG. 1. The displacement of the moveable frame 12 may also be achieved by slidably mounting the variable speed transmission 24 upon base 45 and extending the shaft or guide rod 16 so that this rod is also slidable through the housing end wall 120. Thus, the variable speed transmission 24 and the drive belt 19 are displaceable together with the moveable frame structure 12. In this modification, the bearing 18 is mounted further to the right and the shaft 13 is extended in length so as to be slidable within the bearing 18.

With reference to reciprocating the flyer frame 23 and shaft 13, the shaft 13 is journalled in the bearing block 14 of the frame 12 and this journal provides the connection between shaft 13 and frame 23. Actuation of the motor 17a to move the frame 12 to the right in the direction of the little arrow 31 will also bring about a movement of the shaft 13 and frame 23 to the right.

The spool 20 is mounted upon a shaft 60 the end of which is journalled at 59 and is secured in position by conical members 108 and 110. A nut 111 is threaded on the end of the shaft to tighten the conical member 110 against the flange of the spool. The spool is rotated by means of a motor 61 which transmits drive through a gear 64 on its output shaft in mesh with a gear 65 which is secured to the shaft 60. The spool 20 rotates in a direction opposite to the direction of rotation of the flyer.

It is to be pointed out that other structures for the bearing support and rotary drive for spool 20 may be employed. For example, under certain conditions the rotary drives for the spool and flyer may be coupled or the rotary drive of the spool may be derived from that of the flyer or inversely so that the spool and the flyer rotate at a particular angular velocity relationship with respect to each other. The drive may also be derived from the unit with which the winding apparatus is combined, such as the drawing machine 1 in the present embodiment. When the angular velocity of the spool is to be controlled an adjustable element such as a variable speed transmission may be provided in the drive chain of the spool. When the rotary drives of the flyer and the spool are coupled or when they are derived from each other then only a single common adjustable driving member is required for regulating the rotary speeds of the flyer and spool.

In this respect it is pointed out that a rotary flyer has been used to wind wire on a spool as disclosed in the U.S. Pat. No. 2 931 588. In this known apparatus the spool also rotated but only for the purpose of control. In order to maintain the winding speed of the wire constant the spool was rotated in the same direction with the flyer. This rotation of the spool is actually caused by the wire itself when a certain amount of tension of the wire is exceeded. However, such a known device did not provide for any particular division or proportioning of the winding velocity of the wire between the flyer and the spool but on the contrary the flyer rotated with the same angular velocity during the entire winding operation while the spool continuously accelerated and attained its maximum angular velocity at the maximum weight. This is an unfavorable and undesirable condition which the present invention overcomes.

The reciprocation of the flyer assembly is controlled by two limit switches 30 and 32 which are engageable by a cam 44 on the supporting structure 12 of the flyer during its axial displacement. The engagement of a limit switch reverses the direction of movement of the flyer. The positions of each of the limit switches 30 and 32 can be adjusted by means of two electric motors 40 and 41 which drive spindles 42 and 43 upon which the limit switches are mounted. Alternatively, the positions of the switches can be adjusted manually. The adjustment of the positions is necessary to insure that the wire is placed precisely up to the flanges 21 and 22 and that no depressions or raised portions of wire are formed adjacent the flanges. The limit switches 30 and 32, in effect, define the reversal points of the reciprocating movement of the flyer as it moves in directions parallel to the axis of the spool.

U.S. Pat. No. 3 677 483, Column 2, line 73 - Column 4, line 46 is incorporated herein by reference to describe the structure and manner of controlling the motors 40, 41 and the switches 30, 32.

The control of the motors 40 and 41 to adjust the limits of reciprocation of the flyer as well as the control of the angular velocity of the flyer and/or spool 20 in order to maintain the angular velocity of the wire constant when the spool becomes full or to prevent an uneven surface of wound wire on the spool is accomplished in response to a device for sensing the tension of the wire. This device is positioned in front of the roller 11 and the roller 33 is mounted on the end of a lever 34 which in turn is pivotally mounted at 35 and is counterbalanced by a weight 36. The position of the weight 36 can be adjusted beforehand to impose a predetermined tension upon the wire. Upon an increase in the tension of the wire such as would be caused by the spool becoming full or the wire is wound upon an accumulation of wire upon the spool, the roller 33 will be pulled downwardly in the direction of the arrow 7. A contach arm 8 attached to lever 34 moves over a rheostat 9 which functions as a speed control to reduce the angular velocity of the spool 20 and/or the flyer.

Upon a decrease in the tension of the wire such as would result when the wire runs into a depression of wound wire on spool 20, the roller 33 will move upwardly in the direction of arrow 10 and the reverse procedure will occur with respecct to angular velocity control. In order to maintain a tension on the wire constant in many cases it is sufficient to reduce only once the angular velocity in response to an increase in the tension of the wire.

U.S. Pat. No. 3 677 483, Column 2, lines 19-53 is incorporated herein by reference to describe the structure and manner of controlling the reciprocation of the flyer and angular velocity of the flyer and/or spool.

In order to prevent any possible jamming or binding of guide rollers 5 and 6 in their bearings as a result of centrifugal forces being imposed thereon these rollers are provided with pitched blades 100 as shown in FIGS. 3 and 4 or with a propeller which is not illustrated. The blade arrangement on the rollers will impart an additional torque to the rollers when air strikes the blades upon rotation of the flyer.

A suitable structure as known in the art may be provided to vary the angle of pitch of the blades. Preferred structures are illustrated in FIGS. 7 and 8. In the embodiment of FIG. 7, each blade or vane 100 is mounted for pivotable movement about the axis C-C by means of a pin 112 on one end which is pivotally mounted in an inner ring A of the roller 5 and a similar pin arrangement at the other end of the vane wherein pin 113 is rotatably received in a recess 114 formed in the inner face of the outer cylindrical ring B of the roller. A screw 115 extending into the pin 113 can be loosened to permit angular adjustment of the blade 100 and then tightened to secure the blade 100 in its adjusted position.

In the modification of FIG. 8, a guide roller 210 is secured to a cage 211 and the blades 100 are similarly pivotally mounted with their inner ends journalled in the cage and their outer ends journalled in the outer ring B'. As a result, the blades 100 can be angularly adjusted about the axis C—C.

The inner end of each blade 100 is provided with a pin 212 which is connected to a bevel gear 213. The bevel gears 213 mesh with a further bevel gear 214 from which extends a pin 215 provided with a slot 216. A screwdriver 217 or some other similar tool may be inserted in the slot 216 to pivot the bevel gear 214 and thereby angularly adjust the blades 100.

Varying the pitch of the blades will vary the torque. The flyer can thus be rotated at a speed which exceeds the centrifugal force limit with respect to the bearing friction of the rollers for guiding the wire and with respect to the use of high strength materials and reinforced structure.

A further advantage of mounting the blades on the guide rollers is that a load is removed from the wire since without such blades the wire alone must drive the rollers. This may cause an abnormal stretching of the wire which may bring about a breakage of the wire or at the very least the surface of the wire may be damaged or deteriorated as it slides over the rollers at a speed greater than the peripheral speed of the rollers.

The use of blades on rollers 5 and 6 may replace the above disclosed possibility of rotating the spool 20. However, the use of the blades on the rollers may also be in addition to this rotation of the spool, particularly in those circumstances where the winding velocity of the wire is extremely high.

As can be seen in FIGS. 5 and 6 the rollers may also be driven by an electric motor. From a suitable source of electric current 200 electrical conductors lead to carbon brushes 201 that run on slip rings 202 which are insulated from each other. From the slip rings, suitable current conductors lead to an electric motor 203 which is drivingly connected to the guide roller 5. Additional conductors may lead to a motor connected to roller 4 and similarly to a motor that may be connected to roller 6. The rollers may also be driven by any suitable form of drive including, pneumatic, hydraulic or similar devices.

By driving the rollers with an electric motor or by providing the rollers with fan blades to impart additional torque thereto it is possible to avoid slippage of the wire upon the rollers and resulting damage to both the rollers and the wire. In addition, by avoiding any driving of the roller by the wire passing over the roller it is possible to avoid stretching and resulting breaking of the wire and also excessive tension in winding of the wire.

The spool 20 is mounted on a transportable carriage 104, provided with wheels or rollers 105 to enable the carriage and spool mounted thereon to be readily moved. The housing 120 of the winding apparatus has an opening 102 formed in the wall thereof through which the carriage is moved into and out of the apparatus. The carriage 104 is provided with a shield 103 having a configuration closely conforming to the shape of opening 102 as can be seen in FIG. 2. A handle 106 is mounted on shield 103 to facilitate pulling or pushing the carriage out of or into the opening 102. A reinforcing plate 107 is also mounted on shield 103 and a take-up pin 108 extends therefrom into the bearing core or shaft 60, which is rotatably mounted thereon.

The enclosure 120 has a base 45 upon which are fixed guides 46 to orient and position the carriage with respect to the flyer. In the end position, the carriage 104 is oriented precisely in the three coordinate directions, such as by conical pins of the like, and subsequently locked in this position.

It is therefore apparent that the reciprocation of the flyer in a direction parallel to the axis of the spool provides for winding of uniform layers of wire upon the spool. The speed at which the wire is wound on the spool is regulated by controlling the angular velocity of either the flyer or the spool or of both. The proportioning of the winding velocity of the wire between the flyer and the spool thus provides several control possibilities for maintaining the tension of the wire constant and for obtaining uniform layers of wire on the spool.

Such control possibilities wherein the spool and flyer are controlled individually or jointly was not possible with previously known winding apparatus. In any event, be reducing the angular velocity at which the wire is wound as the spool becomes filled significantly increases the useful operating life of the bearings and reduces the load imposed on the control drives.

The mounting of the spool upon the carriage greatly facilitates the replacement of a full spool with an empty spool since an empty spool may be already mounted upon another carriage and immediately pushed into the wire winding apparatus upon removal of the carriage with the full spool. A suitable coupling device is provided for driving the spool when it is positioned within the winding apparatus. The spool may be constructed to have separable or detachable components so that wound wire can be removed from the core of the spool in the form of a coil.

The winding apparatus of the present invention is used advantageously in conjunction with a wire drawing machine to provide for long operating periods of the combined apparatus together with high speeds of operation. Since the wire winding apparatus of the present convention enables great weights of wire to be quickly wound upon large capacity spools suitable wire drawing machines can be utilized to their fullest capacity. The wire winding apparatus can not only be used in conjunction with a wire drawing machine but in combination with other units such as a rolling mill, an electroplating installation, extruders and the like.

It will be understood that this invention is susceptible to modification in order to adapt it to different usages and conditions, and accordingly, it is desired to comprehend such modifications within this invention as may fall within the scope of the appended claims.

What is claimed is:

1. An apparatus for winding at a high speed a strand, such as wire, cable, rope and the like, upon a spool comprising means for fixedly supporting thereon a spool upon which a strand is to be wound, a rotatably mounted flyer movable around the spool to wind the strand thereon, said flyer comprising a cylindrical frame having a closed end and enclosing the spool and having roller means within the frame on the inner face thereof for guiding the strand entering the flyer at its rotary axis to the spool such that outward movement of the strand within the rotating flyer is limited by the inner face of the frame, means for rotating said flyer around said spool in a direction, said roller means comprising at least one guide roll rotatably mounted on said flyer to guide the strand during winding, and fan blades on said guide roller whereby air currents created by the rotation of the flyer cause the fan blades to rotate the roller.

2. In an apparatus as claimed in claim 1 wherein said blades are mounted for adjusting of the pitch thereof.

3. In an apparatus as claimed in claim 1 and means for rotating said spool supporting means and said spool in a direction opposite to the direction of rotation of said flyer.

* * * * *